US011759386B2

(12) United States Patent
Liu et al.

(10) Patent No.: US 11,759,386 B2
(45) Date of Patent: Sep. 19, 2023

(54) MASSAGE NOZZLE

(71) Applicant: Guangzhou Rising Dragon Recreation Industrial Co., Ltd., Guangzhou (CN)

(72) Inventors: Xuewen Liu, Guangzhou (CN); Huaibin Zhao, Guangzhou (CN)

(73) Assignee: Guangzhou Rising Dragon Recreation Industrial Co., Ltd., Guangzhou (CN)

( * ) Notice: Subject to any disclaimer, the term of this patent is extended or adjusted under 35 U.S.C. 154(b) by 576 days.

(21) Appl. No.: 17/037,639

(22) Filed: Sep. 29, 2020

(65) Prior Publication Data

US 2021/0259908 A1 Aug. 26, 2021

(30) Foreign Application Priority Data

Feb. 24, 2020 (CN) ..... 202010111960.0

(51) Int. Cl.
*A61H 9/00* (2006.01)

(52) U.S. Cl.
CPC ..... *A61H 9/0071* (2013.01)

(58) Field of Classification Search
CPC .... A61H 9/0071; A61H 9/005; A61H 9/0021; A61H 2009/0042; A61H 33/087; A61H 33/33027
USPC ..... 4/615
See application file for complete search history.

(56) References Cited

U.S. PATENT DOCUMENTS

| | | | | |
|---|---|---|---|---|
| 4,731,887 | A * | 3/1988 | Henkin | A61H 33/6063 4/492 |
| 8,272,079 | B2 * | 9/2012 | Long | A61H 35/006 4/541.1 |
| 8,458,825 | B2 * | 6/2013 | Peng | A61H 33/6063 4/492 |
| 2003/0089797 | A1 * | 5/2003 | Buck | B05B 3/0468 239/251 |
| 2005/0039251 | A1 * | 2/2005 | Colin | A61H 33/027 4/541.6 |
| 2007/0033725 | A1 * | 2/2007 | Holtsnider | A61H 33/027 4/541.6 |
| 2013/0048756 | A1 * | 2/2013 | Drury | B05B 7/0425 239/428.5 |

* cited by examiner

*Primary Examiner* — Huyen D Le
(74) *Attorney, Agent, or Firm* — Andrew C. Cheng

(57) ABSTRACT

A massage nozzle includes a nozzle housing and a nozzle core detachably attached in the nozzle housing. The nozzle housing is split-type and includes a cover mounted in a hole of a wall of a hot tub, a nozzle seat and a fastener. The cover includes an end ring and a side wall extending from the end ring. The side wall is conformed with the hole. The nozzle seat includes an inlet and a spray end which has a surface conformed with the side wall. The nozzle seat passes through and detachably connects with the cover. The outer circumferential surface of the spray end contacts with an inner surface of the side wall. The fastener is detachably sleeved on the outer circumferential surface of the nozzle seat and cooperates with the cover to fix the nozzle seat to the hot tub. The installation is convenient and the cost is reduced.

14 Claims, 8 Drawing Sheets

MASSAGE NOZZLE

FIELD

The present invention relates to the technical field of massage nozzles.

BACKGROUND

At present, the traditional massage nozzles on the market are basically installed on the walls of the hot tubs. However, while people are pursuing the appearance of the hot tubs and convenience of the after-sale maintenance of the hot tubs, more and more hot tub manufacturers have begun to choose non-sealed installation of nozzles in the hot tub. That is, a separate backrest is placed inside the hot tub, and the nozzle is installed on the backrest. The traditional massage nozzle usually includes two parts, i.e., an integrally formed nozzle housing and a nozzle core installed in the nozzle housing.

During installation, the nozzle housing is fixed on the wall of the hot tub and a seal between the nozzle housing and the wall is formed by an O-ring or O-gasket or glue, and the nozzle housing is then fastened by a locking nut. However, the nozzle housing protrudes unduly high above the wall after installation. In order not to affect the consumer's application experience, the wall of the hot tub forms corresponding recesses to allow the nozzle to be installed therein, so that the nozzle is flush with the wall or slightly higher than the wall. This solution solves the problem of the nozzle protruding unduly high relative to the wall. But the nozzle core is installed in the nozzle housing and a nozzle core cover at the outlet end of the nozzle core completely covers the nozzle housing. During installation or use of the nozzle, the user has to hold the nozzle core cover to rotate it, which is inconvenient for installation and use of nozzle. Furthermore, once the recess for installing the nozzle is made in the wall, the installation position and size of the nozzle are fixed, which greatly reduces the flexibility and convenience of nozzle installation.

In the case of non-sealed installing the massage nozzle in the hot tub, there is usually no need to consider the sealing problem of the massage nozzle, and due to the mounting surface is a curved surface adapted to the back of the human body, the installation of the massage nozzle on the curved surface will be greatly restricted and the height of the protrusion is bigger. In order to solve the above problems, the curved surface on the installation surface will have to form the corresponding pits. When installing nozzles of different specifications, or layouts of different numbers and positions, it is necessary to use different vacuum molds or injection molds in order to achieve the corresponding installation pits for different nozzles, which requires a large number of molds, thereby increasing the production cost.

Therefore, there is a need to develop an improved massage nozzle which solves at least one of the above problems.

SUMMARY

Accordingly, an improved massage nozzle with a simple structure and reduced thickness is provided.

The massage nozzle includes a nozzle housing and a nozzle core detachably attached in the nozzle housing. The nozzle housing is split-type and comprises a cover configured to be mounted in a hole of a wall of a hot tub, a nozzle seat and a fastener. The cover comprises an end ring and an annular side wall extending from the end ring, the side wall being configured to be conformed with the hole. The nozzle seat comprises an inlet end and a spray end which has a surface conformed with the side wall. The nozzle seat is detachably connected with the cover and an outer circumferential surface of the spray end contacts with an inner surface of the side wall. The fastener is detachably sleeved on the outer circumferential surface of the nozzle seat and cooperates with the cover to fix the nozzle seat to the wall.

In one embodiment, an annular flange extends radially and inward from the annular side wall, a shoulder extends radially and outwardly from the outer circumferential surface of the spray end, the shoulder cooperates with the annular flange to limit the spray end of the nozzle seat in the annular side wall, and an outer circumferential surface of the shoulder contacts with the inner surface of the side wall.

In one embodiment, the annular flange defines a limiting notch and the outer circumferential surface of the spray end provides a limiting protrusion engaged in the limiting notch.

In one embodiment, the massage nozzle further comprises a first sealing element, wherein the first sealing element is arranged at an outer side of the annular side wall for forming a seal between the massage nozzle and a periphery of the hole.

In one embodiment, the first sealing element is L-shaped and comprises a ring end portion and an annular side portion, the ring end portion is conformed with the end ring of the cover to form an end face seal therebetween, and the annular side portion is conformed with the annular side wall of the cover to form an axial seal therebetween.

In one embodiment, the massage nozzle of claim 4 further comprises a second sealing element, wherein the second sealing element is arranged between the nozzle seat and the cover for form a seal between the nozzle seat and the cover.

In one embodiment, the second sealing element is an O-shaped sealing ring.

In one embodiment, the fastener comprises a locking nut with an internal thread, the outer circumferential surface of the nozzle seat provides an external thread close to the cover, and the locking nut is sleeved on the outer circumferential surface of the nozzle seat with a threaded connection formed between the locking nut and the external thread.

In one embodiment, a plurality of backstop teeth is provided at an end of the locking nut facing the wall.

In one embodiment, the fastener comprises a locking sleeve and a predetermined number of screws, the locking sleeve is sleeved on the outer circumferential surface of the nozzle seat, the locking sleeve defines through hole, the annular flange defines threaded holes corresponding to the through holes, and the screws pass through the through hole to engage with the threaded holes respectively such that the locking sleeve cooperates with the cover to fix the nozzle seat to the wall.

In one embodiment, a threaded pressing piece is arranged between the nozzle seat and the nozzle core, an inner side of the pressure piece is provided with an internal thread, and an outer circumferential surface of the nozzle core is provided with an external thread engaging with the internal thread.

In one embodiment, the threaded pressing piece is fastened in the nozzle seat by self-tapping screws.

In one embodiment, the threaded pressing piece is fastened in the nozzle seat in a snap-fitting manner In one embodiment, the cover is made of stainless steel, plastic, ceramic, or glass.

The embodiments of the present application have the following advantages: the nozzle provided by the embodiments of the present application comprises a nozzle core and a split-type nozzle housing. The split-type nozzle housing comprises a cover and a nozzle seat detachably connected to the cover. The split-type nozzle allows the cover and the nozzle seat to be made of different materials. The nozzle seat keeps the material that is convenient for the hot tub manufacturer to connect pipes/hoses. The cover can be made of stainless steel, other decorative plastic materials, or even ceramic or glass materials, which can realize not only the structural function as a part of the nozzle seat but also the appearance function as a part of the nozzle. As no additional decorative cover is needed for covering a portion of the nozzle seat exposed to outside of the wall of the hot tub, the nozzle has a thin overall thickness and the entire height is within 2 mm-4 mm, which will not affect the user's massage experience at all. No recess/pit for installation of the nozzle is needed to be formed in the wall of the hot tub, which makes installation of the nozzle more flexible and convenient. The hot tub manufacturer can also greatly reduce the investment for making molds of hot tub. A gap is formed between the hole of the wall of the hot tub and the cover and an L-shaped sealing element may be received in the gap. When the sealing element is not applied, the nozzle can be installed in the hot tub on a backrest in an unsealed manner. When the sealing element is applied, the nozzle can be installed on the wall of the hot tub in a sealed manner. Demand for simple appearance and integrity of ultra-thin nozzles is increasing. The ultra-thin nozzle of the present application meets this demand. The ultra-thin nozzle of the present application not only realizes simple and diverse installation, but also has a simple and artistic overall appearance after installation. The appearance of the nozzle can change based on changes of shape and material of the cover.

Other independent aspects of the invention will become apparent by consideration of the detailed description, claims and accompanying drawings.

Figure 1:
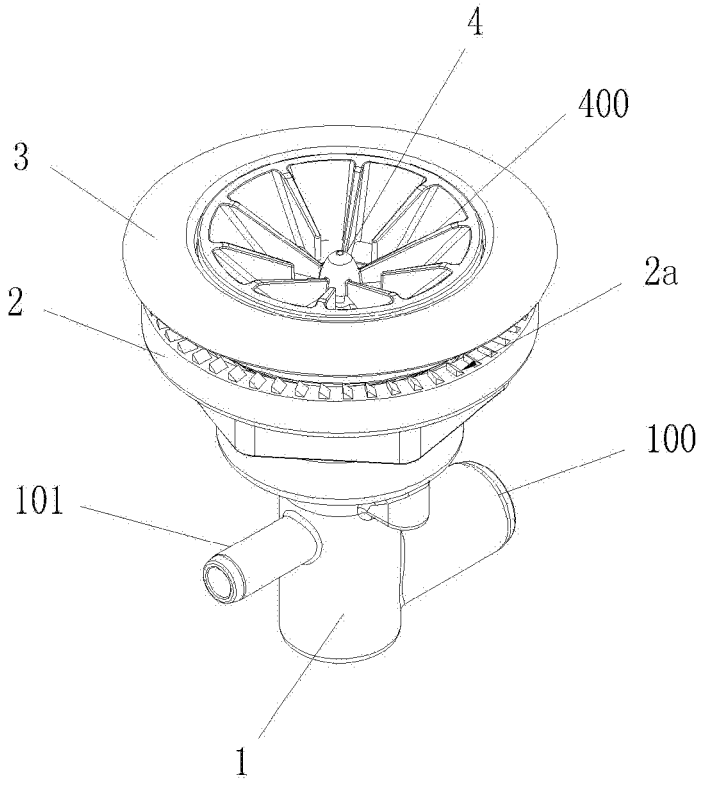
FIG. 1 is a perspective view of a massage nozzle of the present application.

In the drawing: 1—nozzle seat, 1*a*—inlet end, 1*b*—spray end, 2—fastener, 2*a*—retreating teeth, 3—cover, 4—nozzle core, 5—threaded pressing piece, 5*a*—self-tapping screw, 6—second sealing element, 7—first sealing element, 7*a*—ring end portion, 7*b*—annular side portion, 10—wall, 20—through hole, 21—screw, 30—end ring, 30*a*—back surface of the end ring, 31—annular side wall, 31*a*—annular flange, 31*b*—limiting notch, 100—water inlet pipe, 101—air inlet pipe, 102—limiting shoulder, 102*a*—limiting protrusion, 103—locating groove, 400—core cover, 401—rotating shaft, 402—shaft seat, 403—core body, 403*a*—hollow flow passage, 403*b*—water inlet, 403*c*—air inlet.

DESCRIPTION OF THE EMBODIMENTS

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

It is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Further, it should be understood that the orientation or positional relationship indicated by the terms "upper", "lower", "left", "right", "top", "bottom", etc. are based on the drawings shown and are not to be construed as limiting terms. It should be understood that the orientation or positional relationship is only for the convenience of describing the present application and simplifying the description, rather than indicating or implying that the device or element referred to must have a specific orientation, be constructed and operated in a specific orientation, and therefore cannot be understood as a limitation on the scope of the present application.

Furthermore, terms of "first" and "second" which are used to distinguish components or operations described by the same technical terms in this application do not specifically refer to order or sequence, nor are they used to limit the protection scope of this application.

Embodiment 1

Figure 2:
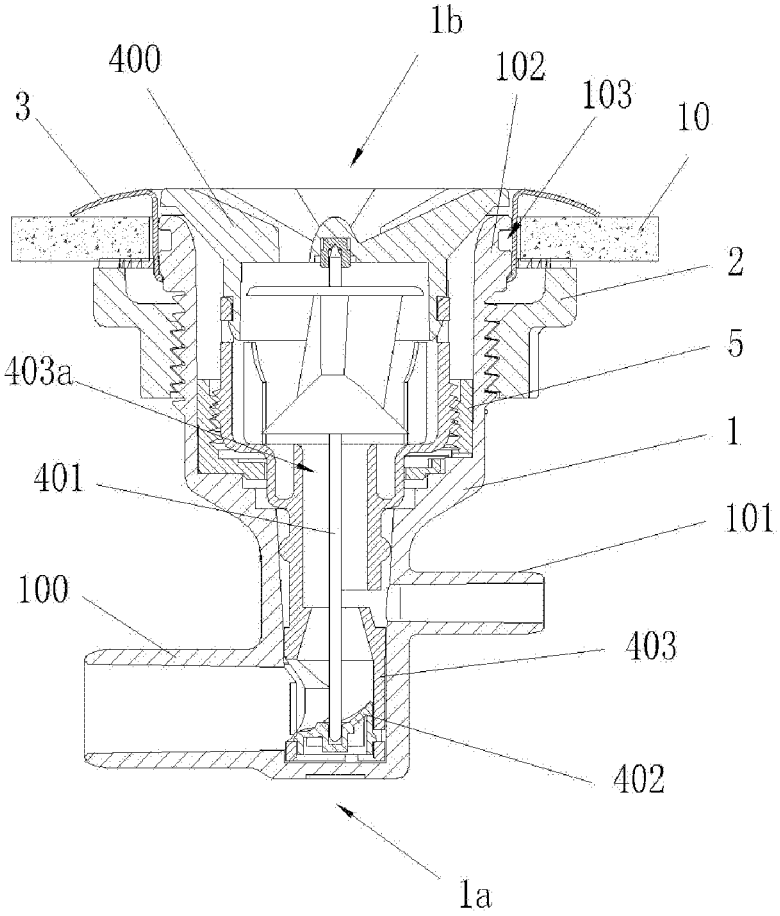
FIG. 2 is a cross section view of the massage nozzle in accordance with a first embodiment of the present application in an installation status.

Referring to FIG. 1 and FIG. 2, a massage nozzle in accordance with an embodiment of the present application is configured for being unsealedly installed in a hot tub on a backrest. The hot tub includes a wall 10 which has a curved surface adapted to the back of the human body. The wall 10 has a predetermined number of holes for installing the massage nozzles. The massage nozzle comprises a split-type nozzle housing and a nozzle core 4 detachably mounted in the nozzle housing. The nozzle housing comprises a nozzle seat 1, a cover 3 and a fastener 2. In assembly, the cover 3 is mounted into the hole of the wall 10, the nozzle seat 1 is installed in the cover 3, the nozzle core 4 is installed in the nozzle seat 1, and the fastener 2 is then sleeved on the outer circumference of the nozzle seat 1. The wall 10 is located between the cover 3 and the fastener 2, and the cover 3 and the fastener 2 cooperates to clamp the wall 10 to thereby realize locking and fixing of the nozzle seat 1.

Figure 7:
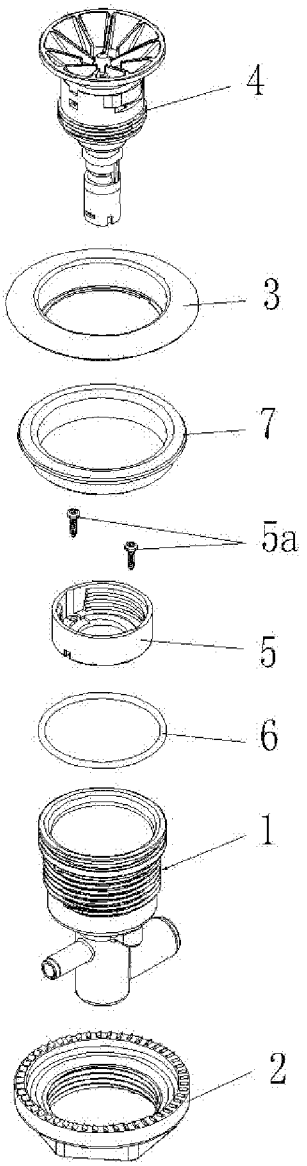
FIG. 7 shows a concept of the first support bracket entirely offset-arranged with respect to the second support bracket in the lateral direction.

Referring to FIG. 1, FIG. 2 and FIG. 7, the nozzle seat 1 comprises an inner cavity (not labelled), an inlet end 1*a* and a spray end 1*b*. The nozzle seat 1 further comprises a limiting shoulder 102 close to the outer periphery of the spray end 1*b*. The inlet end 1*a* is provided with a water inlet pipe 100 and an air inlet pipe 101. The water inlet pipe 100 and the air inlet pipe 101 offset from each other. Water flow is emitted out of the nozzle via the water spray end 1*b*. The nozzle core 4 is accommodated in the cavity. The nozzle core 4 includes a core body 403 and a core cover 400. The core body 403 has a hollow flow passage 403*a* in the middle, and a rotating shaft 401 and a shaft seat 402 are installed in the hollow flow passage 403*a*. The shaft seat 402 is installed at the bottom of the hollow flow passage 403*a*. One end of the rotating shaft 401 is rotatably mounted in the shaft seat 402, and the other end is rotatably connected with the core cover 400.

Figure 3:
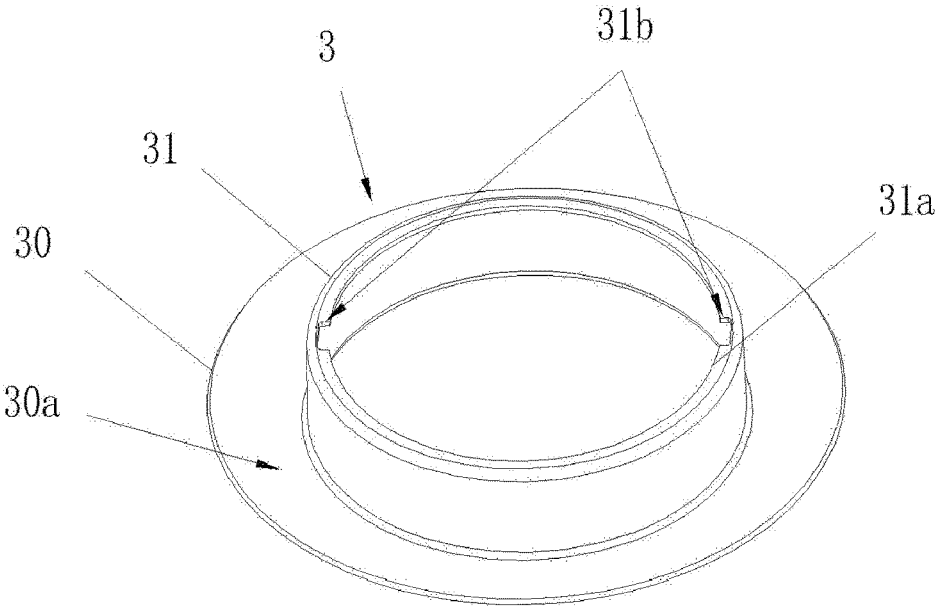
FIG. 3 is a perspective view of a cover of the massage nozzle of the present application.
Figure 4:
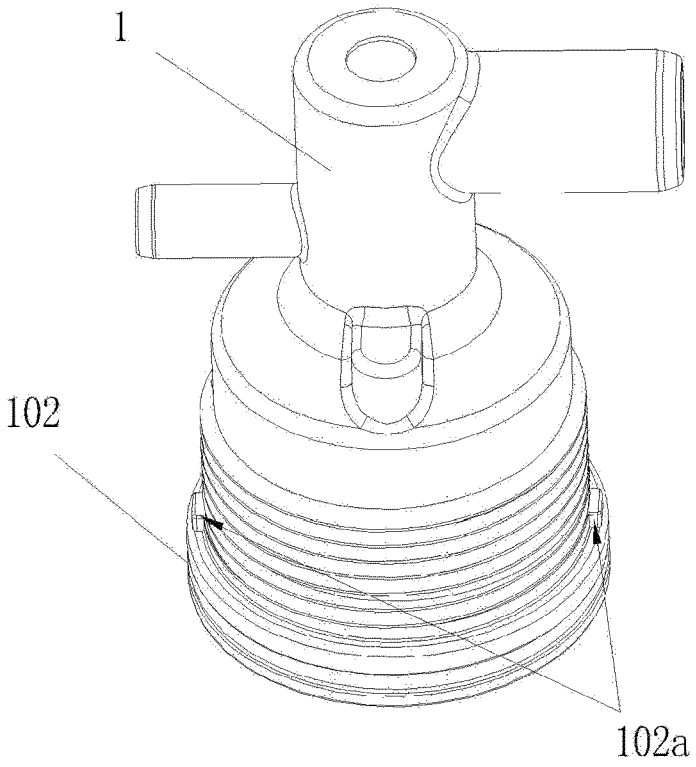
FIG. 4 is a perspective view of a nozzle seat of the massage nozzle of the present application.
Figure 5:
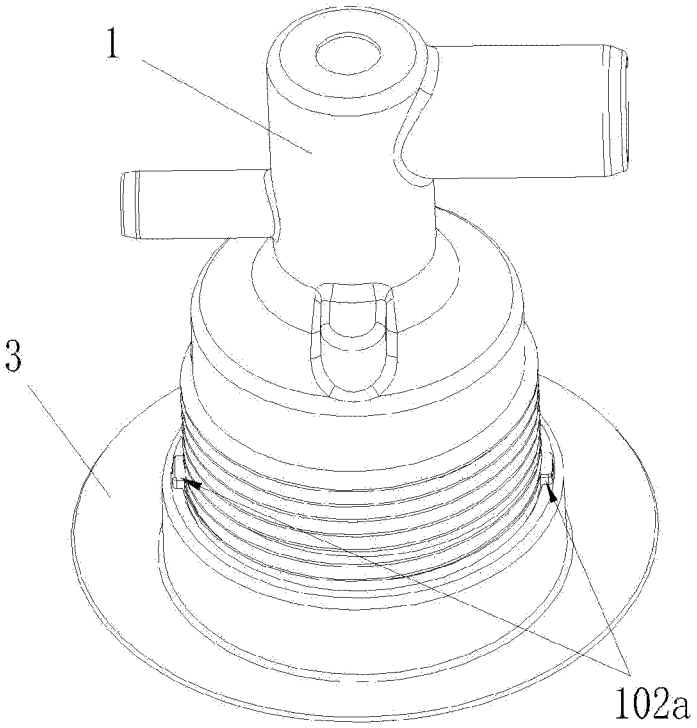
FIG. 5 is an assembled view of the cover and the nozzle seat of the massage nozzle of the present application.

Referring to FIG. 3 to FIG. 5, the cover 3 comprises but is not limited to stainless steel or plastic parts. In the embodiment that the cover 3 is made of stainless steel or plastic, the cover 3 with a thinner wall thickness can be manufactured to thereby reduce the height of the cover 3 beyond the wall 10 after installation. The cover 3 includes an end ring 30 having an end surface with a certain radian. Of course, the end ring 30 can also be flat, as long as it can closely contact with the wall 10. A back surface 30*a* of the end ring 30 is configured to contact with the wall 10. An annular side wall 31 extends perpendicularly from the back surface 30*a* of the end ring 30. In the installed state, the back surface 30*a* of the end ring 30 firmly contacts with the wall 10, and the annular side wall 31 extends into the hole of the wall 10 and the outer circumference of the annular side wall 31 is in contact with the inner surface of the hole. An annular flange 31*a* extends radially and inward from an end of the annular side wall 31 away from the end ring 30. The annular flange 31*a* has an inner diameter less than that of the end ring 30. The nozzle seat 1 extends through the annular side wall 31 of the cover 3, the spray end 1*b* is located in the annular side wall 31, and the outer diameter of the limiting shoulder 102 of the nozzle seat 1 matches the inner diameter of the annular side wall 31. The bottom of the limiting shoulder 102 abuts against the annular flange 31*a* of the annular side wall 31 to form a stop for preventing the nozzle seat 1 from escaping out of the cover 3 axially. Furthermore, a pair of limiting protrusions 102*a* extends from the bottom of the limiting shoulder 102. The pair of limiting protrusions 102*a* is configured to engage with a pair of limiting notches 31*b* formed in the annular flange 31*a* for preventing the nozzle seat 1 from rotating in the circumferential direction.

Referring to FIG. 1 and FIG. 2, in this embodiment, the fastener 2 includes a locking nut which is detachably sleeved on the outer circumference of the nozzle seat 1. The outer surface of one end of the nozzle seat 1 close to the cover 3 is provided with external threads. The inner surface of the locking nut is provided with internal threads for engaging with the external threads of the nozzle seat 1. The engaged threads with self-locking property are capable of preventing the locking nut from loosening after being fastened, thereby firmly locking the nozzle seat 1 to the wall 10.

Further, a predetermined number of backstop teeth 2*a* are provided on one end of the locking nut facing the wall 10. The rotation direction of the backstop teeth 2*a* is opposite to the rotation direction of the internal threads of the locking nut such that the backstop teeth 2*a* are capable of biting the wall 10 to further prevent the locking nut from loosening after being fastened and maintain a more stable locking for the nozzle seat 1.

Further, a threaded pressing piece 5 is arranged between the nozzle seat 1 and the nozzle core 4. The threaded pressing piece 5 is installed in the cavity of the nozzle seat 1 by two self-tapping screws 5*a*. The inner side of the threaded pressing piece 5 is provided with an internal thread, and the outer circumferential surface of the core body 403 of the nozzle core 4 is provided with an external thread for engaging with the internal thread of the threaded pressing piece 5.

Referring to FIGS. 1-5, the massage nozzle provided in this embodiment is installed as follows:

Firstly, the cover 3 is mounted in the hole of the wall 10, and then the nozzle seat 1 is passed through the annular side wall 31 of the cover 3 such that the bottom of the limiting shoulder 102 of the nozzle seat 1 is in close contact with the annular flange 31*a* of the annular side wall 31 of the cover 3. The locking nut is then mounted and tightened such that the locking nut and the cover 3 cooperate to firmly clamp the wall 10 therebetween. As the wall 10 is curved and the cover 3 is a single piece made of stainless steel or plastic such that the cover 3 has a thin wall thickness and good elastic deformation capability, during the process of the locking nut being tightened, the end ring 30 of the cover 3 is deformed until the end ring 30 closely contacts with the curved surface of the wall 10. After installation, the end ring 30 protrudes beyond the wall 10 with 2 mm-4 mm in the thickness direction of the wall 10.

Secondly, the threaded pressing piece 5 is arranged in the cavity and fixed to the nozzle seat 1 via the self-tapping screws 5*a* which pass through the threaded pressing piece 5 to engage with screw holes defined in the nozzle seat 1.

Finally, the nozzle core 4 is assembled. The nozzle core 4 is installed in the cavity of the nozzle seat 1. After installation, a top surface of the nozzle core 4 and the top surface (decorative surface) of the end ring 30 are coplanar with each other. Alternatively, the top surface of the nozzle core 4 may be lower than the top surface (decorative surface) of the end ring 30.

Figure 9A:
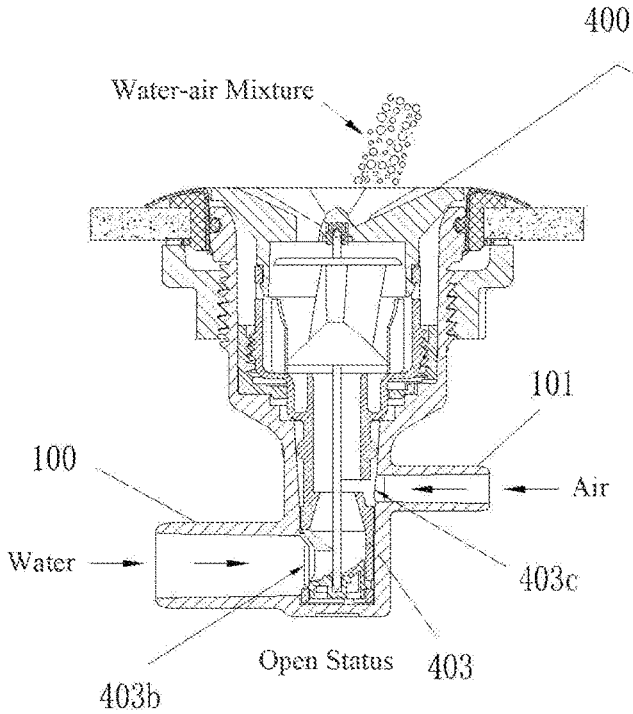
FIG. 9*a* shows the massage nozzle of the present application in an open status.
Figure 9B:
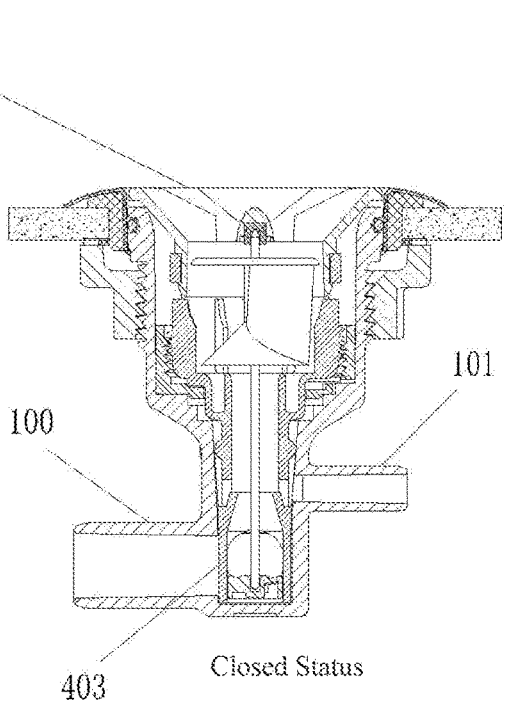
FIG. 9*b* shows the massage nozzle of the present application in a close status.

Referring also to FIG. 9*a* and FIG. 9*b*, in operation, hands of a user rotates the core cover 400 which drives the core body 403 to rotate. In an open state, the water inlet 403*b* and the air inlet 403*c* of the core body 403 respectively communicate with the water inlet pipe 100 and the air inlet pipe 101. Water is injected into the hollow flow passage 403*a* via the water inlet 403*b* and air enters into the hollow flow passage 403*a* via the air inlet 403*c*, and the water flow and the air flow are mixed into a flow of water-air mixture in the hollow flow passage 403*a*. The rotating shaft 401 is rotated and thus the flow of water-air mixture is rotated and sprayed from the sprayed end 1*b*.

In the massage nozzle provided by this embodiment, the cover 3 after being installed is elastically deformed along the curved surface of the wall 10 and closely contacts with the curved surface of the wall 10. The end ring 30 protrudes beyond the wall 10 with 2 mm-4 mm, which does not affect the user experience. The nozzle core 4 is embedded in the cover 3 and is flush with the end ring 30 to avoid the nozzle core 4 extending beyond the cover 3 and affecting the user experience. Furthermore, the wall 10 does not need recesses/pits as designed in the related art which therefore avoids the recesses affecting the user experience in the related art. Thus, the wall 10 can meet installation requirement of massage nozzles of different specifications and/or different layouts, thereby improving the flexibility of nozzle installation, reducing investment of hot tub manufacturers for hot tub molds. The hot tub is more integrity, simple and artistic.

Embodiment 2

Referring to FIG. 1, FIG. 2, FIG. 6 and FIG. 7, this embodiment provides a massage nozzle configured for being sealedly installed on a wall of a hot tub. The wall 10 defines a predetermined number of holes for installing the nozzles. In order to improve the sealing between the massage nozzle and the wall 10, except for the massage nozzle structure of embodiment I, this embodiment further provides a first sealing element 7 and a second sealing element 6. The first sealing element 7 is arranged between the wall 10 and the cover 3 and conformed with the cover 3 for forming a seal between the cover 3 and the wall 10. The second sealing member 6 is arranged between the annular side wall 31 of the cover 3 and the nozzle seat 1 and close to the spray end 1*b* for forming a seal between the nozzle seat 1 and the annular side wall 31, thereby further improving the sealing performance of the installation.

Figure 6:
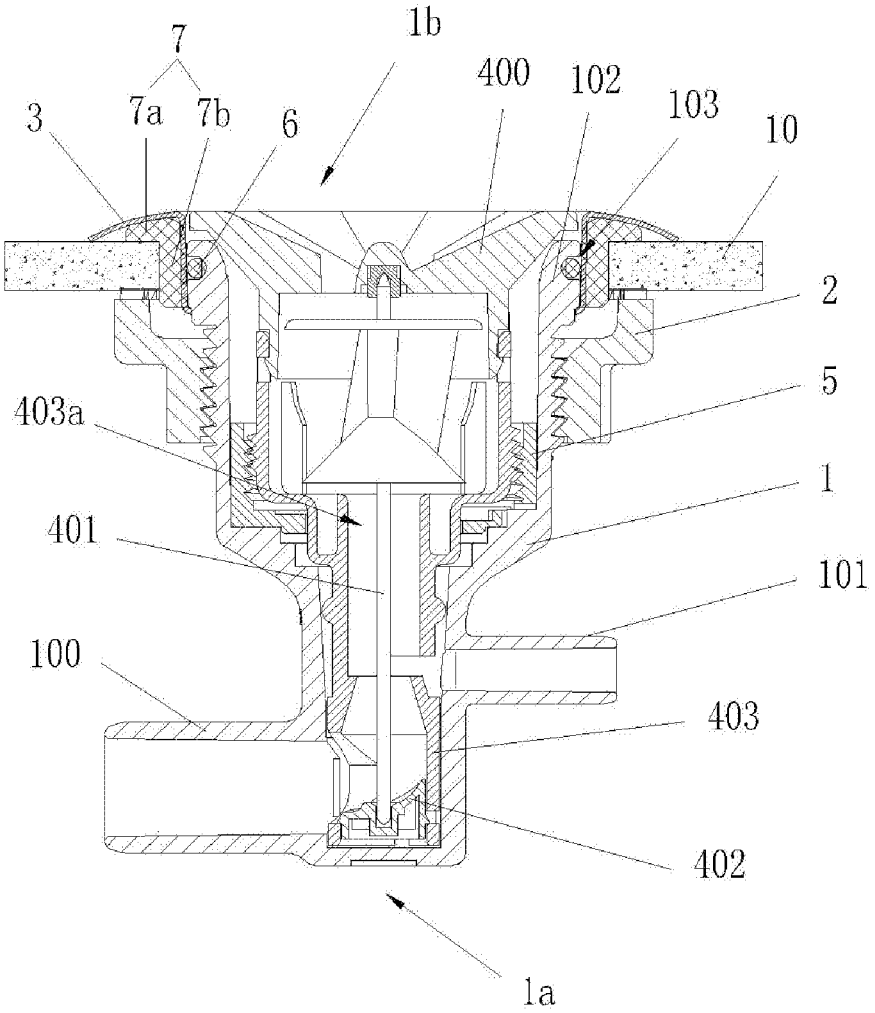
FIG. 6 is a cross section view of the massage nozzle in accordance with a second embodiment of the present application in an installation status.

Referring to FIG. 6, specifically, the first sealing element 7 is an L-shaped sealing ring which includes a ring end portion 7*a* and an annular side portion 7*b* extending from a side of the ring end portion 7*a*. The outer diameter of the ring end portion 7*a* is greater than the outer diameter of the annular side portion 7*b*. The ring end portion 7*a* is conformed with the back surface 30*a* of the end ring 30 to form an end face seal. The annular side portion 7*b* is conformed with the annular side wall 31 to form an axial seal. The second sealing element 6 is an O-shaped sealing ring.

Referring to FIGS. 1-7, the massage nozzle provided in this embodiment is installed as following:

Firstly, the L-shaped sealing ring 7 is mounted in the hole of the wall 10. The diameter of the hole in the wall 10 is the same as or slightly smaller than the outer diameter of the annular side portion 7*b* of the L-shaped sealing ring 7.

Secondly, the cover 3 is pressed into the hole of the wall 10 with the L-shaped sealing ring 7 installed therein, and then the O-shaped sealing ring is mounted in the annular positioning groove 103 defined at the outer circumferential surface of the limiting shoulder 102 of the nozzle seat 1. The nozzle seat 1 is then pressed into the cover 3 such that the bottom of the limiting shoulder 102 of the nozzle seat 1 firmly contacts with the annular flange 31*a* of the annular side wall 31 of the cover 3. The ring end portion 7*a* is configured to form a transverse sealing between the cover 3 and the wall 10 and the annular side portion 7*b* is configured to form a longitudinal sealing between the cover 3 and the wall 10. The O-shaped sealing ring is configured to form a sealing between the limiting shoulder 102 of the nozzle seat 1 and the annular side wall 31 of the cover 3.

Thirdly, the locking nut is mounted and tightened such that the locking nut and the cover 3 cooperate to clamp the wall 10 therebetween. The end ring 30 firmly and closely contacts with the surface of the wall 10. After installation, the end ring 30 protrudes beyond the wall 10 with 2 mm-4 mm in the thickness direction of the wall 20.

Fourthly, the threaded pressing piece 5 is arranged in the cavity and fixed to the nozzle seat 1 via the self-tapping screw 5*a* which pass through the threaded pressing piece 5 to engage with screw holes defined in the nozzle seat 1.

Finally, the nozzle core 4 is assembled. The nozzle core 4 is installed in the nozzle seat 1. After installation, a top surface of the nozzle core 4 and the top surface (decorative surface) of the end ring 30 are coplanar with each other. Alternatively, the top surface of the nozzle core 4 may be lower than the top surface (decorative surface) of the end ring 30.

The operation method of this embodiment is similar to that of embodiment I.

On the basis of applying the solution of embodiment 1, this embodiment applies the first sealing element 7 and the second sealing element 6 which cooperatively sealedly install the massage nozzle on the wall of the hot tub. The flexibility of the massage nozzle provided in Embodiment 1 is greatly improved. No recess/pit for installation of the nozzle is needed to be formed in the wall 10. After installation, the ring end portion 7*a* is hidden behind the back surface of the end ring 30, and achieves the sealing function after the fastener 2 is fastened on the nozzle seat 1. The end ring 30 contacts with the wall 10, and the nozzle core 4 is embedded in the cover 3, and only the end ring 30 extends beyond the wall 10 by 2 mm-4 mm, which also realizes low-protrusion installation without affecting the user experience. The structure of the nozzle is simple, investment on molds is greatly reduced, and production cost is reduced. It is more convenient for installation and use of the nozzle. There are no recesses/pits formed in the wall of the hot tub. The hot tub is more integrity, simple and artistic.

Embodiment 3

Figure 8:
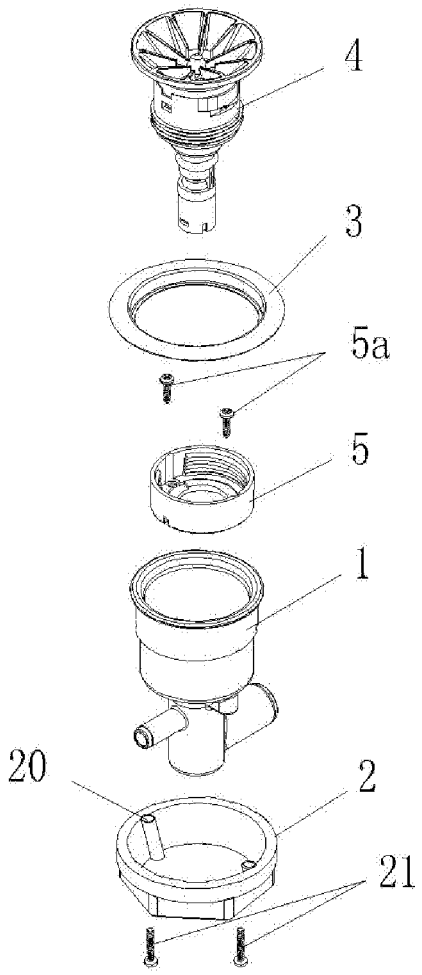
FIG. 8 is a cross section view of the massage nozzle in accordance with a third embodiment of the present application in an installation status, wherein the fastener is a locking sleeve and the first and second sealing elements are not shown.

Referring to FIG. 8, the nozzle of embodiment 3 is similar to the nozzles of the above embodiments except the following differences: the fastener 2 comprises a locking sleeve and a predetermined number of fixing screws 21. The locking sleeve is sleeved on the outer circumference of the nozzle seat 1, and the inner diameter of the locking sleeve matches with the outer diameter of the nozzle seat 1. In this embodiment, the inner diameter of the locking sleeve changes from large to small from the spray end 1*b* to the inlet end 1*a*. Thus, the locking sleeve forms a trumpet shape. The locking sleeve is provided with a predetermined number of unthreaded holes 20. The annular side wall 31 of the cover 3 is provided with the same number of threaded holes corresponding to the unthreaded hole 20. The fixing screw 21 penetrates the unthreaded hole 20 to be engaged in the threaded hole such that the locking sleeve cooperates with the nozzle seat 1 to clamp the wall 10 and prevent the locking sleeve from loosening after being fastened In this embodiment, the backstop teeth 2*a* can be omitted.

Embodiment 4

Figure 10:
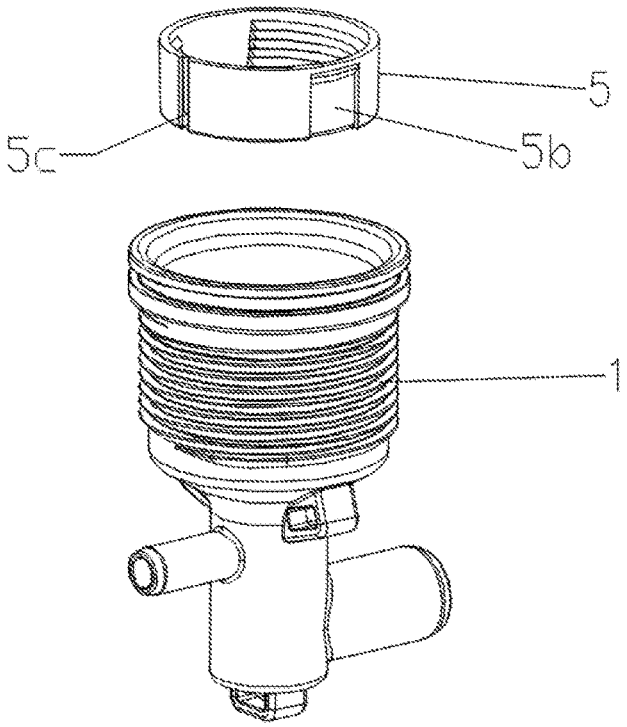
FIG. 10 shows a nozzle seat and a threaded pressing piece which can be assembled to the nozzle seat in a snap-fitting manner.

Referring to FIG. 10, the nozzle of embodiment 4 is similar to the nozzles of the above embodiments except the following differences: the threaded pressing piece 5 is installed in the nozzle seat 1 in a snap-fitting manner. Specifically, the outer periphery of the threaded pressing piece 5 is provided with a locking groove 5*b* and a limiting groove 5*c*. The nozzle seat 1 is provided with a locking block (not shown) configured to engage with the locking groove 5*b* and a limiting block (not shown) configured to engage with the limiting groove 5*c*. The locking groove 5*b* cooperates with the locking protrusion to prevent the threaded pressing piece 5 from falling out of the nozzle seat 1, and the limiting groove 5*c* cooperates with the limiting block to prevent the threaded pressing piece 5 from rotating relative to the nozzle seat 1 in the nozzle seat 1.

Finally, in the embodiments disclosed in the present application, the nozzle seat 1 and the cover 3 are connected and limited to each other by engagement of the limiting shoulder 102 and the annular flange 31*a*. Alternatively, the nozzle seat 1 and the cover 3 can be connected and limited by other simple mechanical connection methods such as threaded connection, snap-fitting connection, screw locking, etc., which is not be repeated here.

The massage nozzles provided by the present application have the advantages of simple structure, low production cost, stable installation, long service life, and overall simplicity and beauty.

Although the invention is described with reference to one or more embodiments, it will be apparent to those skilled in the art that various modifications and variations can be made to the disclosed structure without departing from the scope or spirit of the invention. In view of the foregoing, it is intended that the present invention cover modifications and variations of this invention provided they fall within the scope of the following claims and their equivalents.

What is claimed is:

1. A massage nozzle comprising:

a nozzle housing; and a nozzle core detachably attached in the nozzle housing;

wherein the nozzle housing is split-type, the nozzle housing comprising:

a cover configured to be mounted in a hole of a wall of a hot tub, the cover comprising an end ring and an annular side wall extending from the end ring, the side wall being configured to be conformed with the hole;

a nozzle seat comprising an inlet end and a spray end which has a surface conformed with the side wall, the nozzle seat being detachably connected with the cover, an outer circumferential surface of the spray end contacting with an inner surface of the side wall; and a fastener detachably sleeved on the outer circumferential surface of the nozzle seat and cooperating with the cover to fix the nozzle seat to the wall.

2. The massage nozzle of claim 1, wherein an annular flange extends radially and inward from the annular side wall, a shoulder extends radially and outwardly from the outer circumferential surface of the spray end, the shoulder cooperates with the annular flange to limit the spray end of the nozzle seat in the annular side wall, and an outer circumferential surface of the shoulder contacts with the inner surface of the side wall.

3. The massage nozzle of claim 2, wherein the annular flange defines a limiting notch and the outer circumferential surface of the spray end provides a limiting protrusion engaged in the limiting notch.

4. The massage nozzle of claim 1, further comprising a first sealing element, wherein the first sealing element is arranged at an outer side of the annular side wall for forming a seal between the massage nozzle and a periphery of the hole.

5. The massage nozzle of claim 4, wherein the first sealing element is L-shaped and comprises a ring end portion and an annular side portion, the ring end portion is conformed with the end ring of the cover to form an end face seal therebetween, and the annular side portion is conformed with the annular side wall of the cover to form an axial seal therebetween.

6. The massage nozzle of claim 4, further comprising a second sealing element, wherein the second sealing element is arranged between the nozzle seat and the cover to form a seal between the nozzle seat and the cover.

7. The massage nozzle of claim 6, wherein the second sealing element is an O-shaped sealing ring.

8. The massage nozzle of claim 1, wherein the fastener comprises a locking nut with an internal thread, the outer circumferential surface of the nozzle seat provides an external thread close to the cover, and the locking nut is sleeved on the outer circumferential surface of the nozzle seat with a threaded connection formed between the locking nut and the external thread.

9. The massage nozzle of claim 8, wherein a plurality of backstop teeth is provided at an end of the locking nut facing the wall.

10. The massage nozzle of claim 1, wherein the fastener comprises a locking sleeve and a predetermined number of screws, the locking sleeve is sleeved on the outer circumferential surface of the nozzle seat, the locking sleeve defines through hole, the annular flange defines threaded holes corresponding to the through holes, and the screws pass through the through hole to engage with the threaded holes respectively such that the locking sleeve cooperates with the cover to fix the nozzle seat to the wall.

11. The massage nozzle of claim 1, wherein a threaded pressing piece is arranged between the nozzle seat and the nozzle core, an inner side of the pressure piece is provided with an internal thread, and an outer circumferential surface of the nozzle core is provided with an external thread engaging with the internal thread.

12. The massage nozzle of claim 11, wherein the threaded pressing piece is fastened in the nozzle seat by self-tapping screws.

13. The massage nozzle of claim 11, wherein the threaded pressing piece is fastened in the nozzle seat in a snap-fitting manner.

14. The massage nozzle of claim 1, wherein the cover is made of stainless steel, plastic, ceramic, or glass.

* * * * *